US005694696A

United States Patent [19]

Lee et al.

[11] Patent Number: 5,694,696

[45] Date of Patent: Dec. 9, 1997

[54] SCRAPER PLANE INSERT

[75] Inventors: Leonard G. Lee; John S. Lynn, both of Ottawa, Canada; Charles Paul Hamler, Snellville, Ga.

[73] Assignee: Lee Valley Tools Ltd., Ottawa, Canada

[21] Appl. No.: 695,711

[22] Filed: Aug. 12, 1996

[51] Int. Cl.[6] ..... B27G 17/02

[52] U.S. Cl. ..... 30/488; 30/487; 30/492; 30/169

[58] Field of Search ..... 30/169, 280, 478, 30/487, 488, 489, 492

[56] References Cited

U.S. PATENT DOCUMENTS

| | | | |
|---|---|---|---|
| 13,381 | 8/1855 | Bailey | 30/280 |
| 97,833 | 12/1869 | Tanner | 30/169 |
| 135,341 | 1/1873 | Jones | 30/169 |
| 216,698 | 6/1879 | Price | 30/487 |
| 315,014 | 4/1885 | Duncan | 30/487 |
| 316,296 | 4/1885 | Rodier | 30/492 |
| 383,234 | 5/1888 | Millsap | 30/487 |
| 837,978 | 12/1906 | Traut | 30/169 |
| 1,048,455 | 12/1912 | Burdick | 30/488 |

OTHER PUBLICATIONS

Lee Valley Catalog entitled *10th Anniversary Issue* 1987/88, p. 132.

The Stanley Plane entitled *A History and Descriptive Inventory*, by Alvin Sellens, © 1975, p. 122.

*Primary Examiner*—Hwei-Siu Payer

*Attorney, Agent, or Firm*—John S. Pratt

[57] ABSTRACT

A scraper plane and plane insert that substitutes, in the place of a conventional plane iron or blade and cap iron, a bracket formed by bending sheet mild steel to form two arms, one of which is secured to the frog and the other of which holds a scraper blade in a substantially upright position. Small adjustments in the angle between the scraper blade and plane sole can be made by actuating a micro-adjustment mechanism that forms a bridge between the support arm and securing arm of the bracket.

14 Claims, 3 Drawing Sheets

SCRAPER PLANE INSERT

BACKGROUND OF THE INVENTION

Edge tools called "scrapers" have long been used in woodworking for removing thin shavings of wood or finish from a workpiece. Some such tools, typically called "cabinet scrapers," are used freehand. Other tools are used in holders or plane bodies exemplified by U.S. Pat. No. 5,459,928 for a "Cabinet Scraper Holder" or U.S. Pat. No. 837,978, issued Dec. 11, 1906 to Traut for a "Scraping-Tool."

In the Traut scraping tool, a scraper attachment is substituted for a conventional plane iron in a conventional cast iron bench plane body. The attachment includes a cast metal holder having two arms that, when viewed from the side, meet at an acute angle, one of which arms is longer than the other. The longer arm, which is also penetrated by a slot, is positioned on the plane frog where the plane iron or cutter is normally located, and is held in place by a cap screw and lever cap. A collar holds a scraper blade against the outer face of the shorter arm, which forms an angle with the sole of the plane on the order of 85°, so that the top of the scraper blade is somewhat forward of the bottom, cutting edge, which edge protrudes through the mouth in the sole of the plane body.

Adjustments of the scraper blade in the Traut device appear to be possible by conventional manipulation of the blade depth adjustment mechanism on the plane or, conceivably, by repositioning the scraper blade in relation to the holder by loosening the collar.

SUMMARY OF THE INVENTION

The scraper plane and plane insert of the present invention utilize a conventional plane body, frog assembly, and lever cap. Substituted, however, for the plane iron or cutter is a scraper plane insert that utilizes a bracket formed by bending sheet metal to form two arms, one of which lies against the plane frog and the other of which stands substantially upright, or square to the sole of the plane, to support the scraper blade. The scraper blade is secured to the blade support arm with set screws in a collar surrounding the support arm and the blade. The set screws engage opposite side edges of the blade or support arm, and a micro-adjust mechanism is provided by an adjustable member that forms a bridge between the collar and a pivot block that is held on top of the lever cap by the cap screw. Adjustment of this mechanism causes small changes in the angle between the scraper blade and the sole of the plane.

DETAILED DESCRIPTION OF THE DRAWINGS

Figure 1:
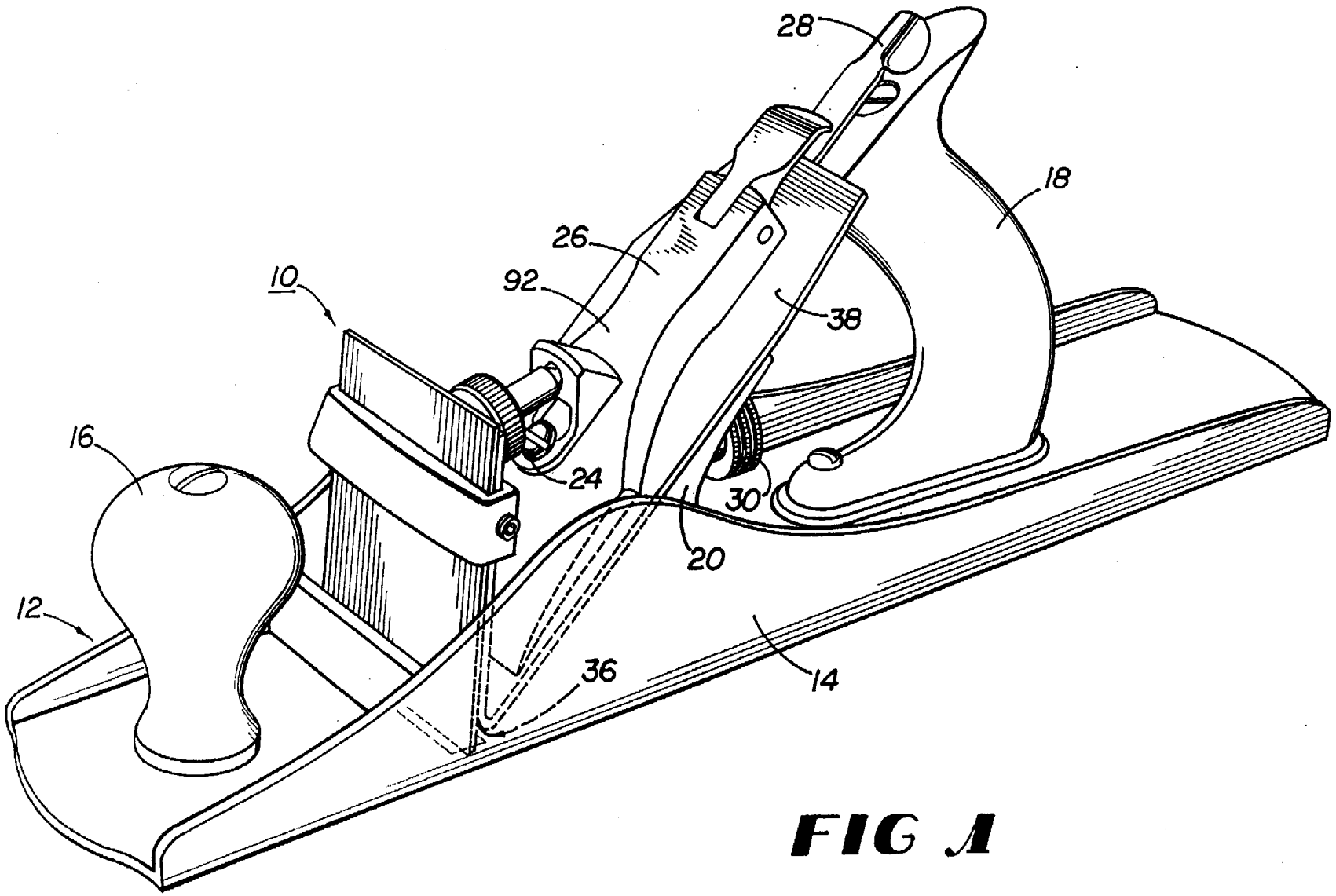
FIG. 1 is a perspective view of the scraper plane insert of the present invention positioned in a conventional bench plane.

FIG. 1 is a perspective view showing the scraper plane insert 10 of the present invention positioned in a conventional bench plane 20. Plane 20 includes generally a plane body or casting 14, a knob 16 at the front of the plane body 14, and a handle 18 at the rear. A frog 20 (also illustrated in FIGS. 2 and 3) is affixed to plane body 14 with frog screws 22. Cap screw 24 passes through lever cap 26, and lateral adjustment lever 28 is attached to frog 20. Cutter adjusting nut 30 causes cutter adjusting levers 32 to move as cutter adjusting nut 30 is rotated on threaded shaft 34.

Figure 5:
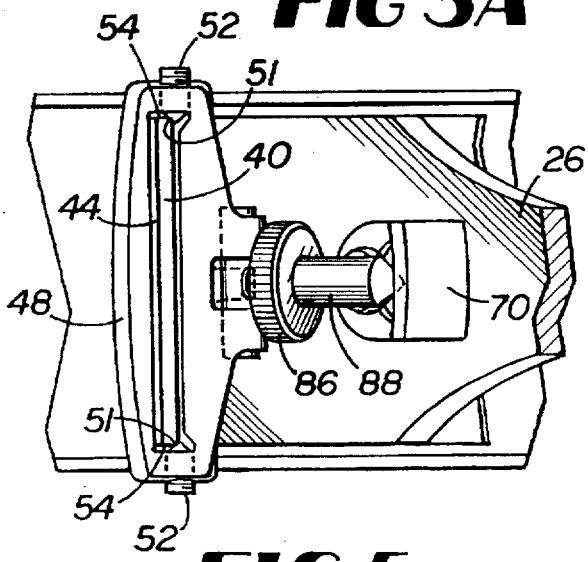
FIG. 5 is a fragmentary top plan view of the scraper plane insert and bench plane of the present invention.

Scraper plane insert 10 comprises a sheet metal bracket 36 that has a plane attachment arm 38 joined to a blade support arm 40. Plane attachment arm 38 is positioned where the bench plane 12 cutter and cutter iron are normally positioned between lever cap 26 and frog 20. When bracket 36 is positioned in plane 12, blade support arm 40 of bracket 36 is substantially square or normal to the bottom 42 of plane 20. Scraper blade 44 lies against the front side 46 of blade support arm 40 and is held in place by clamping collar 48, which surrounds scraper blade 44 and blade support arm 40 by providing a slot 50 through which scraper blade 44 and support arm 40 pass. As is well illustrated in FIG. 5, set screws 52 are positioned in clamping collar 48 so that their conical ends 51 penetrate the ends of slot 50 to engage the side edges 54 of support arm 40 and press blade support arm 40 against scraper 44 to lock scraper 44 in position relative to support arm 40. Force exerted against the side edges 54 of support arm 40 by conical ends 51 has a vector directed to the from of plane 12 and therefore forces support arm 40 forward (or pulls collar 48 back), thereby trapping scraper 44 between support arm 40 and clamping collar 48.

Figure 2:
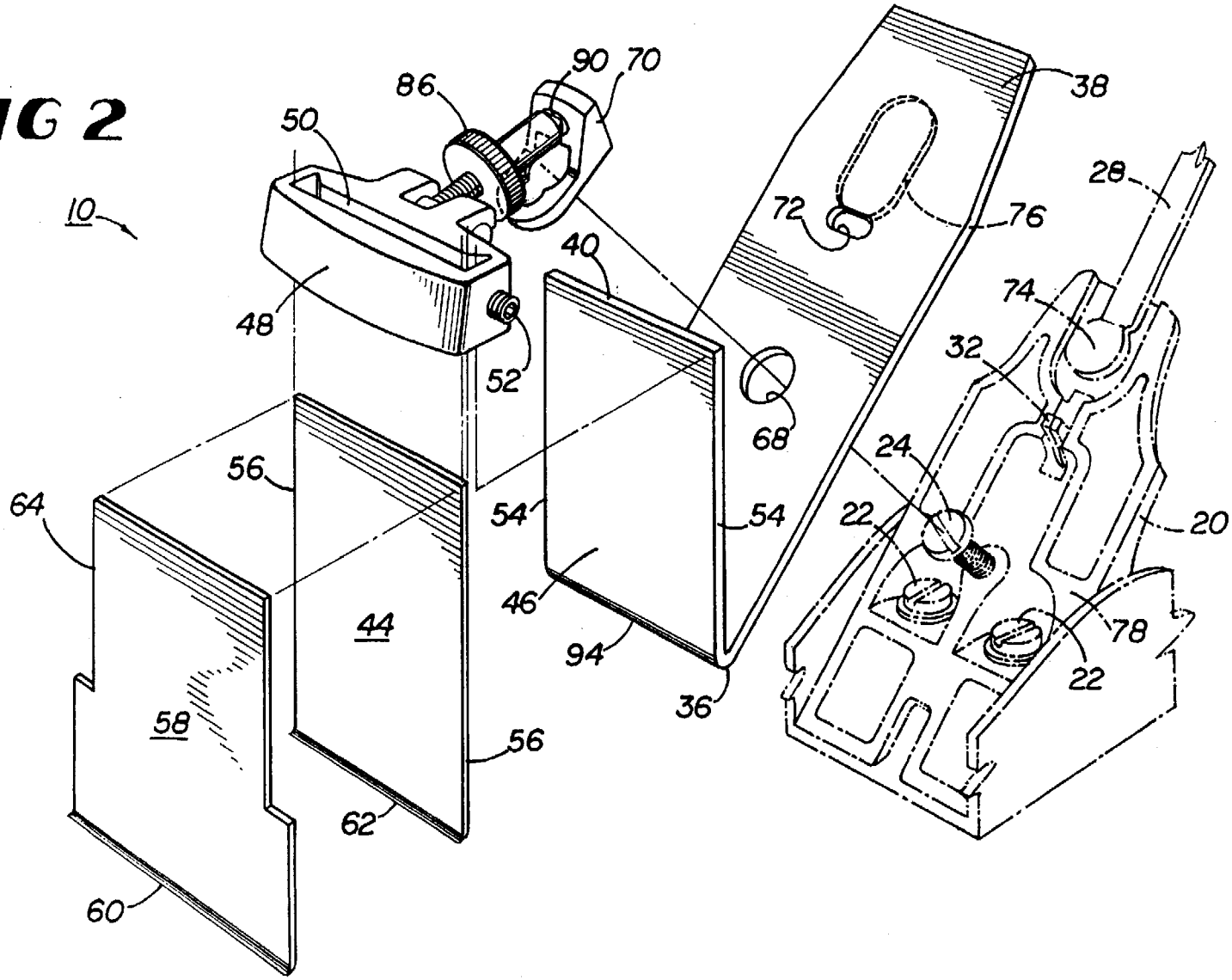
FIG. 2 is a perspective view of the scraper plane insert of the present invention shown exploded away from the frog and a fragment of the plane body, which frog and plane body fragment are shown in broken lines, together with an alternative scraper blade with a wider edge.

As may be seen by reference to FIG. 2, a scraper blade 58 having a cutting edge 60 wider than bracket 36 (and wider than the cutting edge 62 of scraper blade 44) may be used by formation in scraper blade 58 of a narrower region 64 equal in width to the width of blade support arm 40. This makes is possible for scraper plane insert 10 to be utilized with planes having wider mouths 66 than the width of bracket 36.

Bracket 36 is mounted on plane 12 by passing cap screw 24 through a pivot block 70 that lies against lever cap 26, through lever cap 26, and a centrally-located cap screw hole 68 in bracket 36 attachment arm 38. Cutter adjusting levers 32 protrude into an oval hole 72 through attachment arm 38 of bracket 36, and the knob 74 of lateral-adjusting lever 28 is received in an oval depression 76 on the under-surface of attachment arm 38 of bracket 36.

Figure 3:
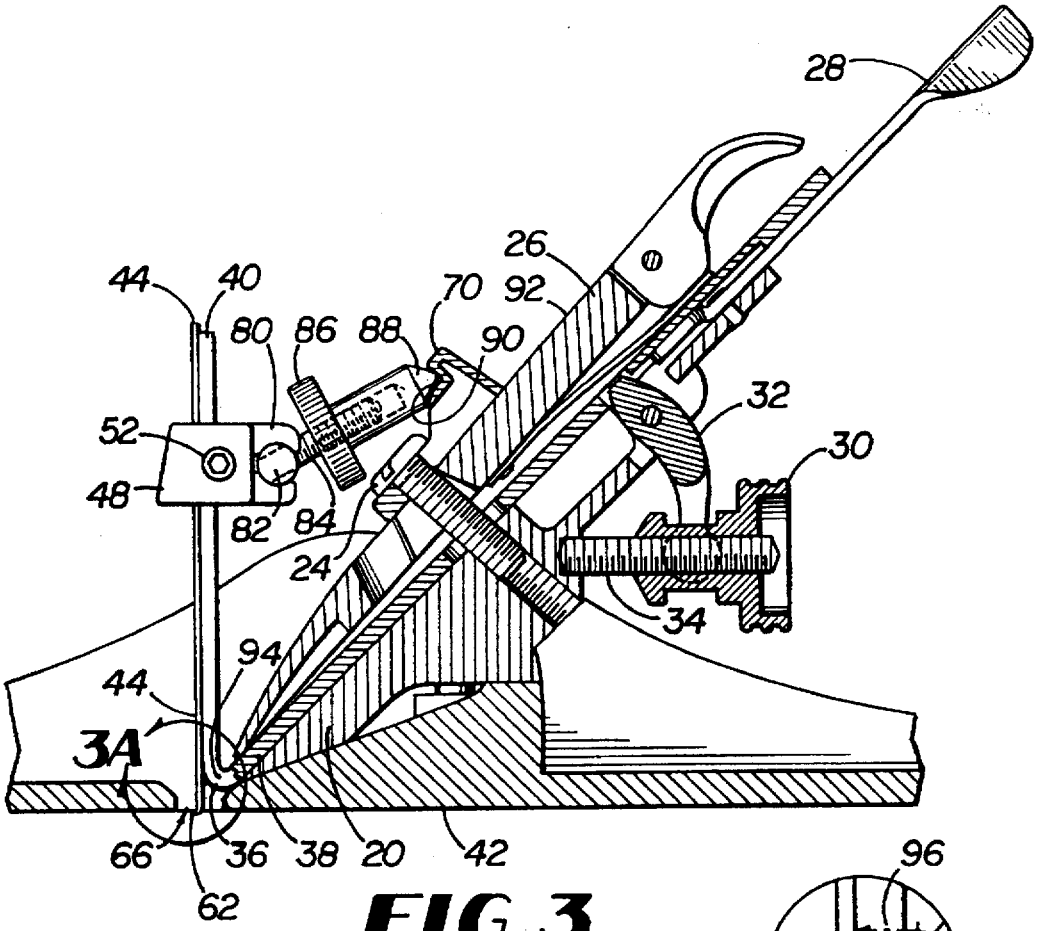
FIG. 3 is a side elevation view, partially in section, of the scraper plane insert of the present invention shown in position in a plane body.

As will be appreciated by reference to the figures, particularly FIGS. 1, 2 and 3, relatively gross adjustment of the position of scraper blade 44 and the protrusion into mouth 66 of its cutting edge 62 are made when scraper blade 44 is clamped to the face 46 of blade support arm 40 of bracket 36 utilizing clamping collar 48.

Relatively fine adjustment of the position of cutting edge 62 may be made by manipulation of cutter adjusting nut 30 to force attachment arm 38 of bracket 36 to slide up and down the face 78 of frog 20.

Additionally, fine adjustment of the protrusion and angle of presentation of cutting edge 62 is achieved utilizing features of the present invention that permit extremely precise adjustments. This adjustment apparatus is provided by a yoke 80 formed on the rear of clamping collar 48, which yoke grasps a short bar 82 to which a threaded shaft 84 is attached. A thumb nut 86 is threaded onto threaded shaft 84. Thumb nut 86 has a conical tip that is received by a depression 90 in pivot block 70. As noted above, pivot block 70 is secured against the top 92 of lever cap 26. When the bar 82 is positioned within yoke 80 and thumb nut 86 is threaded onto threaded shaft 84 so that conical tip 88 rests in depression 90 of pivot block 70, a mechanical bridge is provided between support arm 40 and attachment arm 38 of bracket 36. Rotation of thumb nut 86 in a direction causing it to move away from bar 82 applies force to clamping collar 48, thereby causing blade support arm 40 to pivot forward which, in turn, causes slight rotation of cutting edge 62 into or beyond mouth 66 of plane 12.

As will also be appreciated by reference to the figures, because the above described adjustment mechanism does not prevent the support arm 40 from pivoting further forward, it can do so and thereby flex to a natural position during use of the plane 12 with scraper plane insert 10. Furthermore, "pre-loading" the scraper plane insert 10 utilizing thumb screw 86 not only adjusts the position and depth of cutting edge 62 but also reduces the possibility of chatter during use.

Figure 3A:
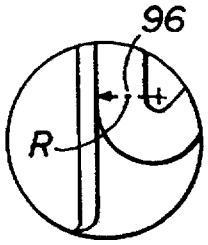
FIG. 3A is an enlarged inset view of the portion of the present invention in circle 3A in FIG. 3.
Figure 4:
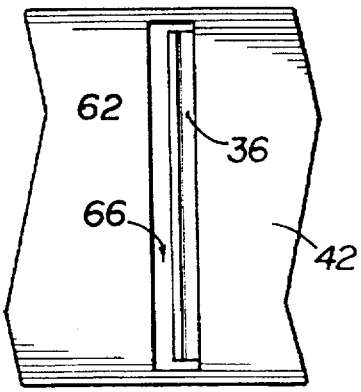
FIG. 4 is a bottom plan view of the mouth of the plane body showing the position of the scraper blade relative to the mouth.

As can be seen by reference to FIGS. 2, 3, and 3A support arm 40 and attachment arm 38 of bracket 36 are connected along a bend 94 that has a relatively substantial radius 96 (see FIG. 3A). This relatively substantial radius 96 permits the scraper blade 44 to flex slightly during use, "wrapping" itself to a certain degree around the radius 96, and thereby maintaining surface contact between bracket 36 and cutter 44 and reducing chatter, with a consequently smoother cut. This feature of the present invention can be further utilized by selecting different bending radii 96 for bend 94 in bracket 36.

As noted above, set screws 52 are used for securing clamping collar 48. Since such set screws 52 are typically harder than the mild steel or other material from which bracket 36 is formed, set screws 52 will form small depressions in the sides 54 of support arm 40, which depressions are useful reference points when replacing a sharpened scraper blade to facilitate returning the collar 48 and blade 44 to their previous position. Such depressions also assist in resisting the tendency for blade 44 and collar 48 to be forced upward during use of the apparatus.

As will be appreciated by those skilled in the art, use of a bracket 36 formed by bending mild steel plate not only facilitates the desirable features of the present invention described above, but also presents manufacturing economies over alternative fabrication techniques such as casting. Bracket 36 can, however, be formed from a wide variety of materials utilizing a variety of techniques, provided that bracket 36 retains the ability for blade support arm 40 to flex, bend or pivot slightly along bend 94 as described above (such an ability to flex, bend or pivot is not taught or suggested by the Traut patent). For instance, bracket 36 could be cast or molded in a variety of plastic and metal materials. Collar 48 and pivot blocks 70 may also be formed from a number of materials, including iron, brass, and plastics, particularly including glass-filled nylon.

While the present invention is described by reference to its preferred embodiments as illustrated in the drawings, the invention is not limited to such drawings or the foregoing description, but includes numerous variations of each within the scope of the following claims.

We claim:

1. A scraper plane insert for use in a plane having a plane body, a frog, a lever cap, and a cap screw, comprising:

(a) a scraper blade;

(b) a bracket having a planar upright blade support arm joined to a sloping planar attachment arm;

(c) a clamping collar for securing the scraper blade to the blade support arm, the clamping collar comprising:

(1) a collar body having a slot within which the scraper blade and blade support arm are positioned;

(2) a pair of set screws threaded into the collar body to contact the blade support arm, and (3) a yoke;

(d) a pivot block to be secured atop the lever cap by the cap screw, the pivot block having a depression for receiving a conical point;

(e) a micro-adjustment screw assembly for positioning between the yoke and the pivot block to exert force to pivot the blade support arm away from the attachment arm, the micro-adjustment screw assembly comprising:

(1) a threaded shaft attached at one end to the central region of a bar to be received in the yoke; and (2) threaded onto the other end of the threaded shaft, an internally threaded thumb nut from which a cone-tipped rod protrudes to be received in the pivot block point-receiving depression.

2. The scraper plane insert of claim 1, wherein the bracket is formed from sheet metal.

3. The scraper plane insert of claim 2, wherein the sheet metal is mild steel.

4. The scraper plane insert of claim 3, wherein the blade support arm and the sloping attachment arm are joined along a linear bend that forms a radius between the support and attachment arms.

5. The scraper plane insert of claim 1 wherein the sloping planar attachment arm is penetrated by a cap screw hole to receive the cap screw for securing the bracket to the frog.

6. The scraper plane insert of claim 1 wherein the collar body and pivot block are made of glass filled nylon.

7. A scraper plane insert for substituting for a conventional plane blade and cap iron in a plane having a frog; a lever cap; a cap screw; and a bench plane body, which body has a sole penetrated by a mouth, the scraper plane insert comprising:

(a) a scraper blade having a scraping edge, (b) a means for supporting the scraper blade in a generally upright position relative to the sole of the bench plane body with the scraping edge of the blade protruding through the mouth, the supporting means comprising a bracket having a planar upright blade support arm joined to a sloping planar attachment arm, (c) a means for securing the scraper blade to the supporting means, (d) a means for adjusting by a relatively small amount the angle between the supporting means and the sole of the plane body by exerting force to pivot the bracket blade support arm away from the bracket attachment arm.

8. The scraper plane insert of claim 7, wherein the supporting means is formed from sheet metal.

9. The scraper plane insert of claim 8, wherein the sheet metal is mild steel.

10. The scraper plane insert of claim 7, wherein the supporting means is penetrated by a cap screw hole to receive the cap screw for securing the supporting means to the frog.

11. The scraper plane insert of claim 7, wherein at least a portion of the securing means is made of glass filled nylon.

12. A scraper plane comprising:

(a) a scraper blade;

(b) a sheet metal bracket having an upright arm and a sloping arm;

(c) a clamping collar for securing the scraper blade to the upright bracket arm;

(d) a plane body;

(e) a frog secured to the plane body;

(f) a lever cap;

(g) a pivot block;

(h) a cap screw passing through and securing the pivot block, the lever cap and the sloping bracket arm to the frog; and (i) a micro-adjust assembly for exerting force to separate the bracket arms.

13. A scraper plane insert micro-adjustment screw assembly comprising:

(a) a yoke, (b) a pivot block having a point-receiving depression, (c) a threaded shaft attached at one end to the central region of a bar to be received in the yoke; and (d) threaded onto the other end of the threaded shaft, an internally threaded thumb nut from which a cone-tipped rod protrudes to be received in the pivot block point-receiving depression.

14. The scraper plane insert micro-adjustment screw assembly of claim 13, further comprising a clamping collar attached to the yoke and at least one set screw threaded into the collar.

* * * * *